US009194068B2

(12) United States Patent
Okuyama et al.

(10) Patent No.: US 9,194,068 B2
(45) Date of Patent: Nov. 24, 2015

(54) SEWING MACHINE AND NON-TRANSITORY COMPUTER-READABLE MEDIUM STORING SEWING MACHINE CONTROL PROGRAM

(71) Applicant: BROTHER KOGYO KABUSHIKI KAISHA, Nagoya-shi, Aichi-ken (JP)

(72) Inventors: Tsuneo Okuyama, Inabe-gun (JP); Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/518,452

(22) Filed: Oct. 20, 2014

(65) Prior Publication Data

US 2015/0128837 A1 May 14, 2015

(30) Foreign Application Priority Data

Nov. 13, 2013 (JP) ..... 2013-235282

(51) Int. Cl.
*D05B 19/12* (2006.01)

(52) U.S. Cl.
CPC ..... *D05B 19/12* (2013.01)

(58) Field of Classification Search
CPC ..... D05B 19/02; D05B 19/08; D05B 19/12
USPC ..... 700/136, 138; 112/102.5, 475.05
See application file for complete search history.

(56) References Cited

U.S. PATENT DOCUMENTS 4,834,007 A * 5/1989 Miyazaki et al. ..... 112/470.04
5,270,939 A * 12/1993 Goldberg et al. ..... 700/138
5,319,565 A 6/1994 Hausammann et al.
5,383,413 A * 1/1995 Hayashi ..... 112/102.5
5,911,181 A * 6/1999 Muto ..... 112/102.5
5,911,182 A * 6/1999 Uyama et al. ..... 112/102.5
6,189,467 B1 * 2/2001 Tomita ..... 112/102.5
6,304,793 B1 * 10/2001 Komiya et al. ..... 700/138
8,897,907 B2 * 11/2014 Ikeba ..... 700/138
2002/0100403 A1 * 8/2002 Terao ..... 112/470.05
2006/0027153 A1 2/2006 Hirata et al.
2012/0067263 A1 3/2012 Ikeba

FOREIGN PATENT DOCUMENTS

JP A-5-161770 6/1993
JP A-2006-43231 2/2006
JP A-2012-61140 3/2012

* cited by examiner

*Primary Examiner* — Danny Worrell
(74) *Attorney, Agent, or Firm* — Oliff PLC

(57) ABSTRACT

A sewing machine includes a needle bar, a feed mechanism, a swinging mechanism, a display device, and a control device. The control device determines whether each one of a plurality of sets of sewing data for sewing a pattern is editable, displays on the display device, editable pattern described by the sewing data that has been determined to be editable, and acquires a selection command that selects an object pattern from among the editable pattern. The control device also acquires edit command to edit the selected object pattern, edits object sewing data that are for the object pattern, in accordance with the edit command that has been acquired, and causes the sewing machine to sew the object pattern on a sewing workpiece, based on the edited object sewing data, by operating the feed mechanism that moves the sewing workpiece and the swinging mechanism that swings the needle bar.

6 Claims, 11 Drawing Sheets

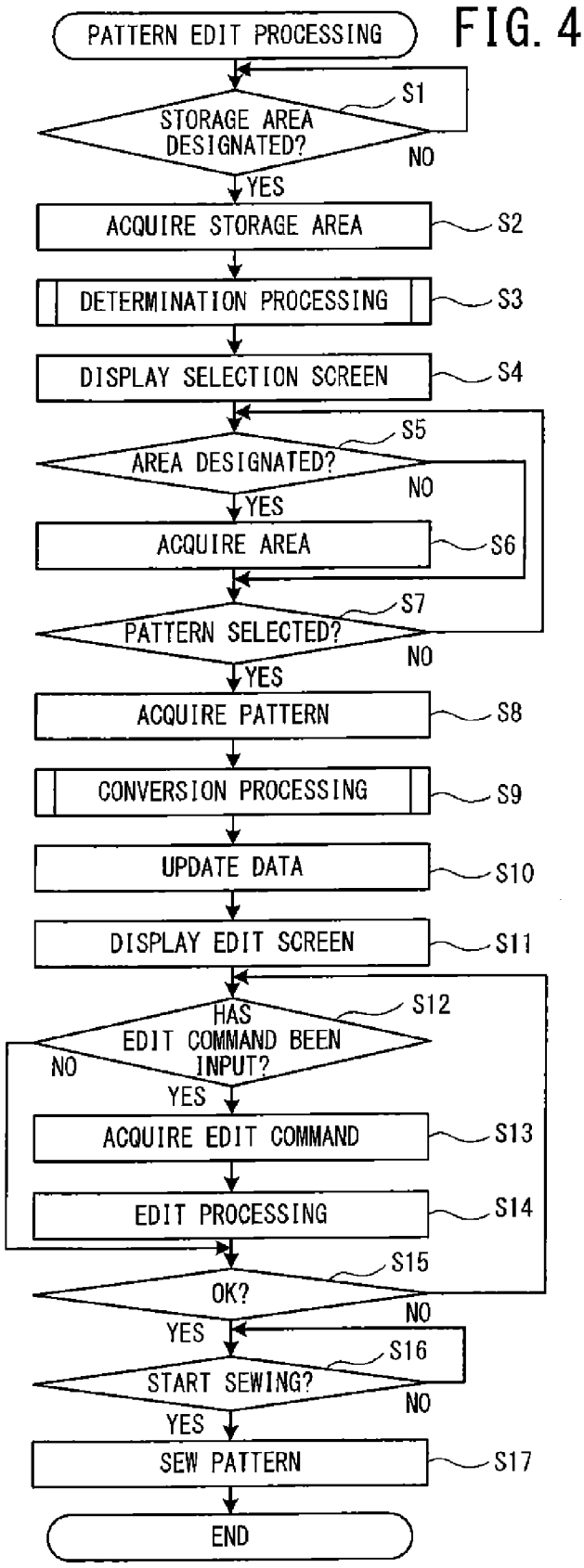
FIG. 4
PATTERN EDIT PROCESSING
STORAGE AREA DESIGNATED?
S1
NO
YES
ACQUIRE STORAGE AREA
S2
DETERMINATION PROCESSING
S3
DISPLAY SELECTION SCREEN
S4
AREA DESIGNATED?
S5
NO
YES
ACQUIRE AREA
S6
PATTERN SELECTED?
S7
NO
YES
ACQUIRE PATTERN
S8
CONVERSION PROCESSING
S9
UPDATE DATA
S10
DISPLAY EDIT SCREEN
S11
HAS EDIT COMMAND BEEN INPUT?
S12
NO
YES
ACQUIRE EDIT COMMAND
S13
EDIT PROCESSING
S14
OK?
S15
NO
YES
START SEWING?
S16
NO
YES
SEW PATTERN
S17
END

FIG. 6

641

| PATTERN ID | SEWING ORDER | FIRST FEED AMOUNT | SWING POSITION | SECOND FEED AMOUNT |
|---|---|---|---|---|
| 1 | 1 | 0.0 | 2.0 | - |
| | 2 | 5.0 | 0.5 | - |
| | ⋮ | ⋮ | ⋮ | ⋮ |
| 2 | 1 | 0.0 | 2.3 | - |
| | 2 | 5.0 | 0.5 | - |
| | ⋮ | ⋮ | ⋮ | ⋮ |
| 3 | 1 | 0.0 | 8.0 | - |
| | 2 | 5.0 | 0.5 | - |
| | ⋮ | ⋮ | ⋮ | ⋮ |
| 4 | 1 | 0.0 | 0.0 | 2.0 |
| | 2 | 5.0 | 0.0 | 1.0 |
| | ⋮ | ⋮ | ⋮ | ⋮ |
| ⋮ | ⋮ | ⋮ | ⋮ | ⋮ |

SEWING MACHINE AND NON-TRANSITORY COMPUTER-READABLE MEDIUM STORING SEWING MACHINE CONTROL PROGRAM

CROSS-REFERENCE TO RELATED APPLICATION

This Application claims priority to Japanese Patent Application No. 2013-235282, filed on Nov. 13, 2013, the content of which is hereby incorporated by reference.

BACKGROUND

The present disclosure relates to a sewing machine that is provided with a swinging mechanism that swings a needle bar, and to a non-transitory computer-readable medium that stores a sewing machine control program.

A pattern data creation device is known that, in accordance with a command from a user, generates sewing data for sewing a pattern. The sewing data are data that specify an amount that a sewing workpiece is fed by a feed mechanism and a position to which a needle bar is swung by a swinging mechanism. The pattern data creation device is built into a sewing machine that is provided with a feed mechanism that has a feed dog and with a swinging mechanism that swings a needle bar. By operating the feed dog, the feed mechanism moves a sewing workpiece in a first direction. The swinging mechanism swings the needle bar in a second direction that intersects the first direction. In a case where the user will create the sewing data for a new pattern in the sewing machine, the user sequentially inputs a plurality of needle drop points on a touch panel with which the sewing machine is provided. The sewing machine creates the sewing data for the pattern based on the needle drop points that have been input.

SUMMARY

However, in a case where the user is a beginner, the work of creating the sewing data for a new pattern from the beginning is not very easy. Therefore, a sewing machine is desired on which the user is able to create the sewing data for a new pattern by utilizing the sewing data for an existing pattern.

Various embodiments of the broad principles derived herein provide a sewing machine that is able of create sewing data easily, the sewing data being data for sewing a pattern, data that specify an amount that a sewing workpiece is fed by a feed mechanism and a position to which a needle bar is swung by a swinging mechanism, and various embodiments also provide a non-transitory computer-readable medium that stores a sewing machine control program.

Embodiments provide a sewing machine that includes a needle bar, a feed mechanism, a swinging mechanism, a display device, a storage device, and a control device. The feed mechanism moves a sewing workpiece in a first direction. The swinging mechanism swings the needle bar in a second direction that intersects the first direction. The storage device stores a plurality of sets of sewing data. The control device determines whether each one of the plurality of sets of sewing data is editable. Each set of the sewing data is data for sewing a pattern. The control device also displays at least one editable pattern on the display device, based on the result of the editability determination. The at least one editable pattern is a pattern that is described by one of the plurality of sets of the sewing data that has been determined to be editable. Further, the control device acquires a selection command that selects, from among the at least one editable pattern that is displayed on the display device, an object pattern that will be subject to editing, and acquires edit command to edit the object pattern that is selected by the acquired selection command. The control device also edits object sewing data, which are the sewing data, among the plurality of the sets of the sewing data, that are for the object pattern, in accordance with the edit command that has been acquired, and causes the sewing machine to sew the object pattern on the sewing workpiece by operating the feed mechanism and the swinging mechanism based on the edited object sewing data.

Embodiments also provide a non-transitory computer-readable medium storing computer-readable instructions that is executable on a sewing machine, the instructions, when executed by the sewing machine, cause the sewing machine to perform processes including determining whether each one of a plurality of sets of sewing data that are stored in a storage device is editable. Each set of the sewing data is data for sewing a pattern. The processes also include displaying at least one editable pattern on a display device, based on the result of the editability determination. The at least one editable pattern is a pattern that is described by one of the plurality of sets of the sewing data that has been determined to be editable. Further, the processes include acquiring a selection command that selects, from among the at least one editable pattern that is displayed on the display device, an object pattern that will be subject to editing, and acquiring edit command to edit the object pattern that is selected by the acquired selection command. The processes also include editing object sewing data, which are the sewing data, among the plurality of the sets of the sewing data, that are for the object pattern, in accordance with the edit command that has been acquired, and sewing the object pattern on a sewing workpiece by operating a feed mechanism and a swinging mechanism based on the edited object sewing data. The feed mechanism moves the sewing workpiece in a first direction, and the swinging mechanism swings a needle bar in a second direction that intersects the first direction.

BRIEF DESCRIPTION OF THE DRAWINGS

Embodiments will be described below in detail with reference to the accompanying drawings in which:

FIG. 4 is a flowchart of pattern edit processing;

FIG. 6 is an explanatory figure of a sewing data storage area 641 that stores a plurality of sets of sewing data;

DETAILED DESCRIPTION

Figure 1:
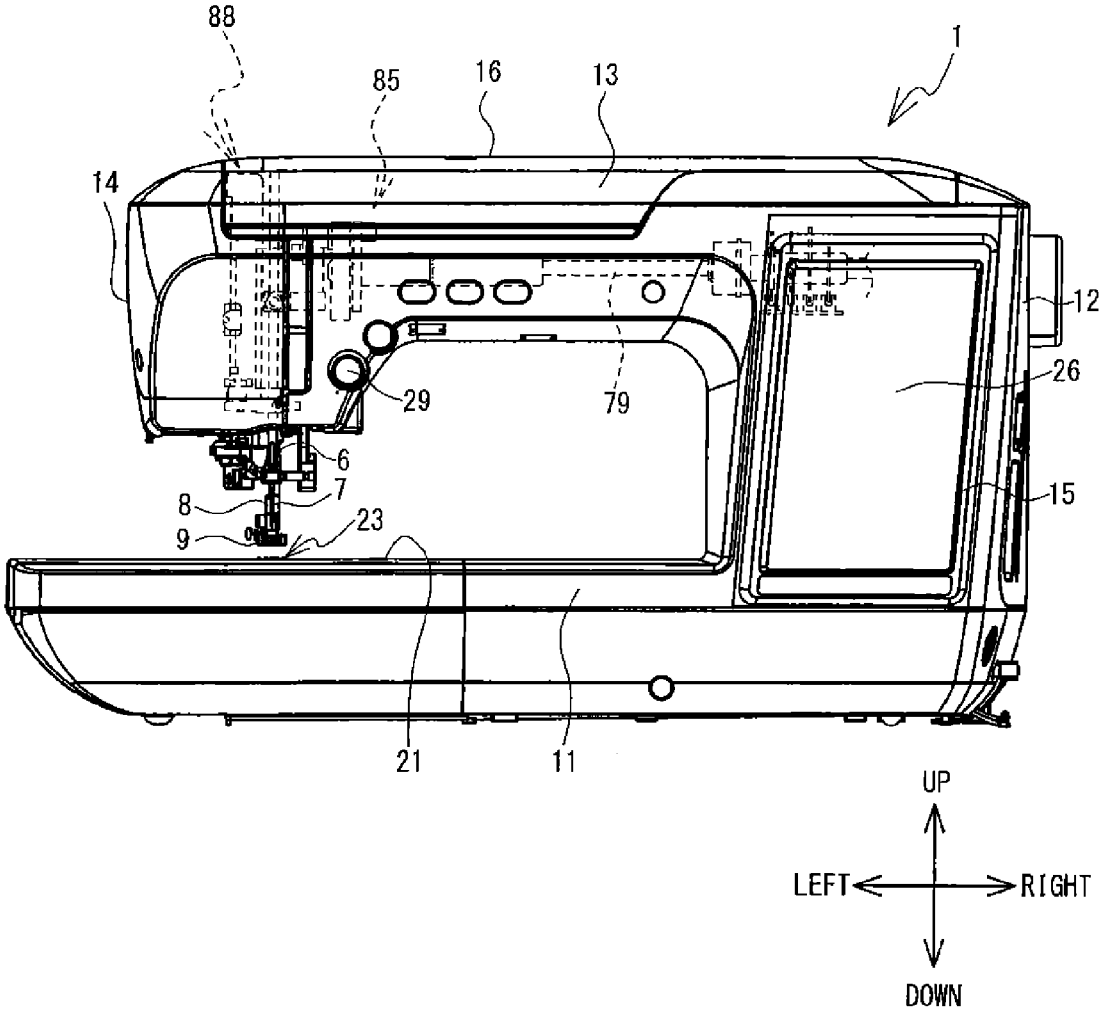
FIG. 1 is a front view of a sewing machine 1.

Hereinafter, an embodiment will be explained with reference to the drawings. Note that the drawings are used for explaining technological features that the present disclosure can utilize and do not serve to restrict the content of the present disclosure. A physical configuration of a sewing machine 1 will be explained with reference to FIG. 1. The up-down direction and the left-right direction in FIG. 1 respectively correspond to the up-down direction and the left-right direction of the sewing machine 1. That is, the face of the sewing machine 1 on which a liquid crystal display 15 that will be described later is disposed is the front face of the sewing machine 1. Lengthwise directions of a bed 11 and an arm 13 are the left-right direction of the sewing machine 1, and the side of the sewing machine 1 on which a pillar 12 is disposed is the right side of the sewing machine 1. The direction in which the pillar 12 extends is the up-down direction of the sewing machine 1.

As shown in FIG. 1, the sewing machine 1 is provided with the bed 11, the pillar 12, the arm 13, and a head 14. The bed 11 is a base portion of the sewing machine 1 that extends in the left-right direction. The pillar 12 extends upward from the right end of the bed 11. The arm 13 extends to the left from the upper end of the pillar 12, such that the arm 13 is opposite the bed 11. The head 14 is a component that is coupled to the left end of the arm 13.

The bed 11 is provided with a needle plate 21 on the top face of the bed 11. The needle plate 21 includes a needle hole (not shown in the drawings). Underneath the needle plate 21 (that is, inside the bed 11), the sewing machine 1 is provided with a feed dog 23, a feed mechanism 89 (refer to FIG. 2), a feed adjustment motor 87 (refer to FIG. 2), a shuttle mechanism, and the like. The feed dog 23 is driven by the feed mechanism 89 and feeds a sewing workpiece (for example, a work cloth) in a first direction (the front-rear direction) by a specified feed amount. The feed adjustment motor 87 adjusts the feed amount of the feed dog 23. The shuttle mechanism entwines an upper thread with a lower thread (not shown in the drawings) below the needle plate 21.

The liquid crystal display (hereinafter called the LCD) 15 is provided on the front face of the pillar 12. The LCD 15 displays a screen that includes various types of items, such as commands, illustrations, setting values, messages, and the like. A touch panel 26 that is able to detect a pressed position is provided on the front face side of the LCD 15. When a user performs a pressing operation on the touch panel 26 using a finger or a stylus pen (not shown in the drawings), the pressed position is detected by the touch panel 26. Based on the pressed position that has been detected, a controller of the sewing machine 1 recognizes an item that has been selected on the screen. Hereinafter, the pressing operation by the user on the touch panel 26 will be called a panel operation. The user can use a panel operation to select a pattern to be sewn, a command to be executed, and the like. A sewing machine motor 81 (refer to FIG. 2) is provided in the interior of the pillar 12. A connector 38 (refer to FIG. 2) is provided on the right side face of the pillar 12. A USB memory 37 (refer to FIG. 2) can be mounted in the connector 38. A different storage medium or a storage device may also be mountable in the connector 38, instead of the USB memory 37.

An opening and closing cover 16 is provided in the upper portion of the arm 13. In FIG. 1, the cover 16 is shown in a closed state. A spool containing portion is provided under the cover 16, that is, in the interior of the arm 13, although it is not shown in the drawings. The spool containing portion contains a thread spool (not shown in the drawings) on which the upper thread is wound. A drive shaft 79 that extends in the left-right direction is provided in the interior of the arm 13. The drive shaft 79 is rotationally driven by the sewing machine motor 81 (refer to FIG. 2). Various types of switches that include a start/stop switch 29 are provided in the lower left portion of the front face of the arm 13. The start/stop switch 29 starts and stops operation of the sewing machine 1, that is, it is used for inputting commands to start and stop sewing.

A needle bar 6, a presser bar 8, a needle bar up-down drive mechanism 85, a swinging mechanism 88, and the like are provided in the head 14. The needle bar 6 and the presser bar 8 extend downward from the bottom end of the head 14. A sewing needle 7 is removably mounted on the lower end of the needle bar 6. A presser foot 9 is removably attached to the lower end of the presser bar 8. The needle bar up-down drive mechanism 85 drives the needle bar 6 up and down in accordance with the rotation of the drive shaft 79. The swinging mechanism 88 is a mechanism that is configured to swing the needle bar 6 in a second direction (the left-right direction) that intersects the first direction. The swinging mechanism 88 swings a needle bar base (not shown in the drawings) in the left-right direction by causing a swinging motor 86 (refer to FIG. 2) to serve as a drive source for driving an eccentric swinging cam (not shown in the drawings) that rotates, although this is not shown in detail in the drawings. The needle bar 6 is swung in the left-right direction by the swinging of the needle bar base in the left-right direction.

Figure 2:
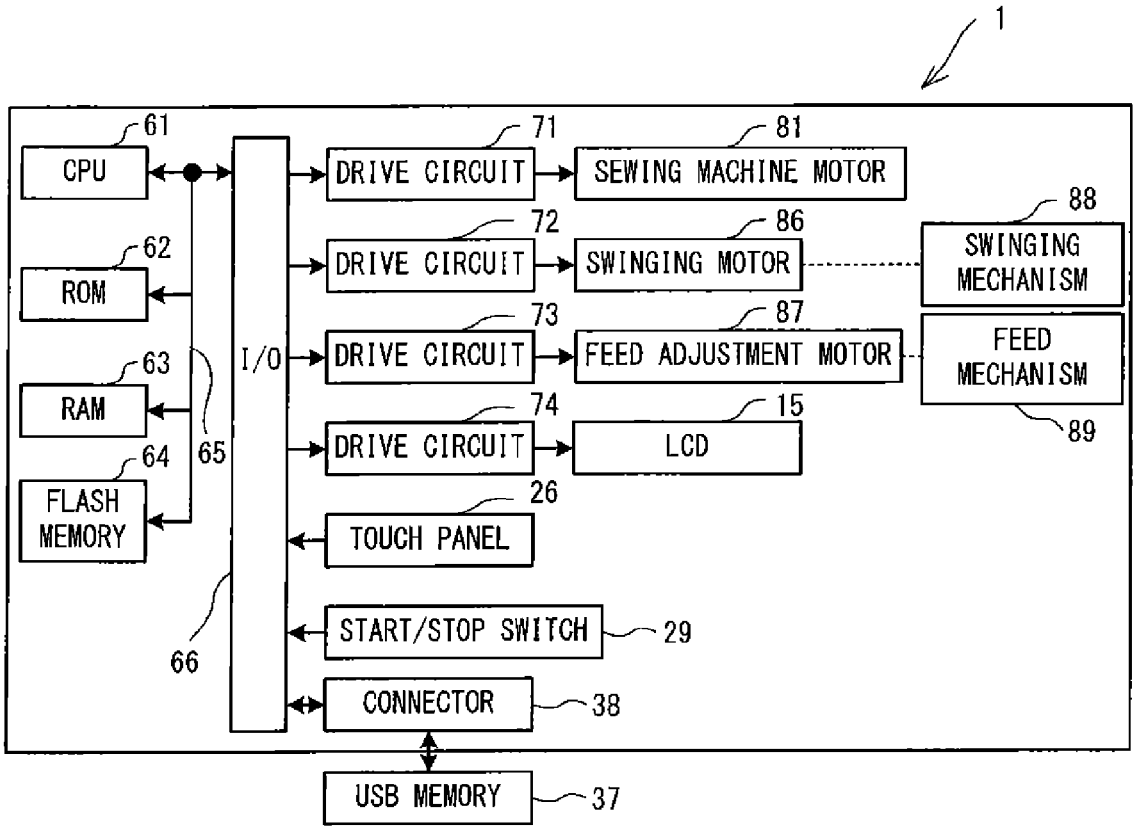
FIG. 2 is a block diagram that shows an electrical configuration of the sewing machine 1.

An electrical configuration of the sewing machine 1 will be explained with reference to FIG. 2. As shown in FIG. 2, the sewing machine 1 is provided with a CPU 61, as well as a ROM 62, a RAM 63, a flash memory 64, and an input/output interface (I/O) 66, each of which is connected to the CPU 61 by a bus 65.

The CPU 61 performs main control of the sewing machine 1 and, in accordance with various types of programs that are stored in the ROM 62, performs various types of computations and processing that have to do with sewing. The ROM 62 is provided with a plurality of storage areas that include a program storage area, although these are not shown in the drawings. Various types of programs for operating the sewing machine 1 are stored in the program storage area. For example, the stored programs include a program for causing the sewing machine 1 to perform pattern edit processing that will be described later.

Storage areas that contain computation results and the like from computational processing by the CPU 61 are provided in the RAM 63 as necessary. Various types of parameters and the like for the sewing machine 1 to perform various types of processing are stored in the flash memory 64. The flash memory 64 is provided with a sewing data storage area 641 (refer to FIG. 6) that stores a plurality of sets of sewing data. In the same manner, the USB memory 37 is provided with a sewing data storage area (not shown in the drawings) that stores a plurality of sets of sewing data.

The sewing data are data for sewing a pattern. The sewing data include data that specify amounts that the sewing workpiece will be fed by the feed mechanism 89 (the feed dog 23) and data that specify positions to which the needle bar 6 will be swung by the swinging mechanism 88. Hereinafter, the data that specify the positions to which the needle bar 6 will be swung by the swinging mechanism 88 will simply be called the swing positions. The directions in which the sewing workpiece is fed are the first direction (the front-rear direction) and the second direction (the left-right direction). Hereinafter, the data that specify the amounts that the sewing workpiece will be fed in the first direction will simply be called the first feed amounts. The data that specify the amounts that the sewing workpiece will be fed in the second direction will simply be called the second feed amounts. In some cases, the data that specify the feed amounts for the sewing workpiece include only the first feed amounts, and in other cases, they include both the first feed amounts and the second feed amounts.

In the present embodiment, a plurality of patterns are divided into groups of three types, type 1 patterns, type 2 patterns, and type 3 patterns, depending on the sewing data for the individual patterns. The sewing data for the type 1 pattern include the first feed amounts and the swing positions. The swing positions in the sewing data for the type 1 pattern are compatible with the swing positions of the needle bar 6 of the sewing machine 1. A case in which the swing positions are compatible with the swing positions of the needle bar 6 is a case in which the swing positions that are included in the sewing data are within a range in which the needle bar 6 can be swung by the swinging mechanism 88 and in which the swing positions that are included in the sewing data are integer multiples of a minimum swing amount (a minimum swing pitch) by which the needle bar 6 is swung by the swinging mechanism 88. The sewing data for the type 2 pattern include the first feed amounts and the swing positions. The swing positions in the sewing data for the type 2 pattern are not compatible with the swing positions of the needle bar 6 of the sewing machine 1. A case in which the swing positions are not compatible with the swing positions of the needle bar 6 is a case in which the swing positions that are included in the sewing data are outside the range in which the needle bar 6 can be swung by the swinging mechanism 88 or in which the swing positions that are included in the sewing data are not integer multiples of the minimum swing pitch by which the needle bar 6 is swung by the swinging mechanism 88. The range in which the needle bar 6 can be swung by the swinging mechanism 88 may be from 0.0 millimeters to 7.0 millimeters, for example. The minimum swing pitch for the needle bar 6 may be 0.5 millimeters, for example. The range in which the needle bar 6 can be swung and the minimum swing pitch are stored in the flash memory 64. The sewing data for the type 3 pattern include the first feed amounts, the swing positions, and the second feed amounts. In FIG. 6, the units are millimeters for the first feed amount, the swing position, and the second feed amount.

Drive circuits 71 to 74, the touch panel 26, the start/stop switch 29, and the connector 38 are connected to the I/O 66. The sewing machine motor 81 is connected to the drive circuit 71. The drive circuit 71 drives the sewing machine motor 81 in accordance with a control signal from the CPU 61. In conjunction with the driving of the sewing machine motor 81, the needle bar up-down drive mechanism 85 is driven through the drive shaft 79 (refer to FIG. 1) of the sewing machine 1, and the needle bar 6 is moved up and down. The swinging motor 86 is connected to the drive circuit 72. The drive circuit 72 drives the swinging motor 86 in accordance with a control signal from the CPU 61. In conjunction with the driving of the swinging motor 86, the swinging mechanism 88 is driven, and the needle bar 6 is swung in the second direction (the left-right direction). The drive circuit 73 drives the feed adjustment motor 87 in accordance with a control signal from the CPU 61. In conjunction with the driving of the feed adjustment motor 87, the amount by which the sewing workpiece is fed by the feed dog 23 (refer to FIG. 1), which the feed mechanism 89 drives, is adjusted. By driving the LCD 15 in accordance with a control signal from the CPU 61, the drive circuit 74 causes an image to be displayed on the LCD 15.

Figure 3:
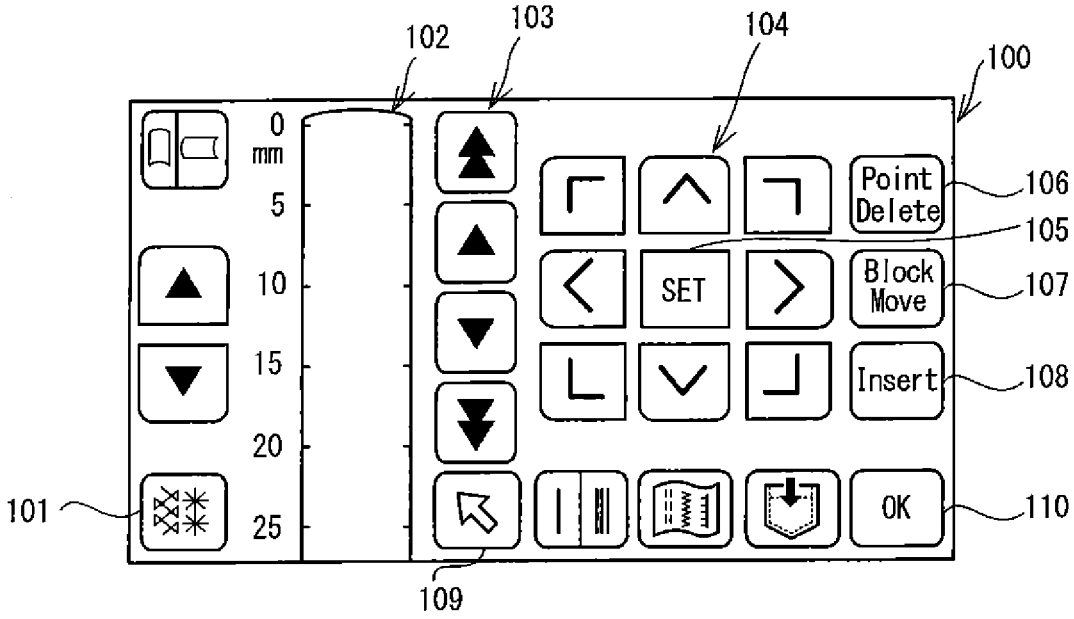
FIG. 3 is an explanatory figure of an edit screen 100.

An edit screen 100 will be explained with reference to FIG. 3. The edit screen 100 that is shown in FIG. 3 is a screen that is displayed on the LCD 15 in a case where the user has used a panel operation to input a command to start editing of a pattern. The edit screen 100 is provided with a pattern edit key 101, a campus 102, a point movement key cluster 103, an arrow key cluster 104, a Set key 105, a Point Delete key 106, a Block Move key 107, an Insert key 108, an area designation key 109, and an OK key 110.

The pattern edit key 101 is selected in a case where editing of a pattern will be performed using existing sewing data that are stored in one of the flash memory 64 and the USB memory 37 that is connected to the sewing machine 1. The sewing machine 1 of the present embodiment is able to perform editing of the sewing data for the type 1 patterns and the type 2 patterns that were described above. However, the sewing machine 1 is not provided with a feed mechanism that feeds the sewing workpiece in the second direction by driving the feed dog 23, so it is not able to perform editing of the sewing data for the type 3 patterns.

Figure 9:
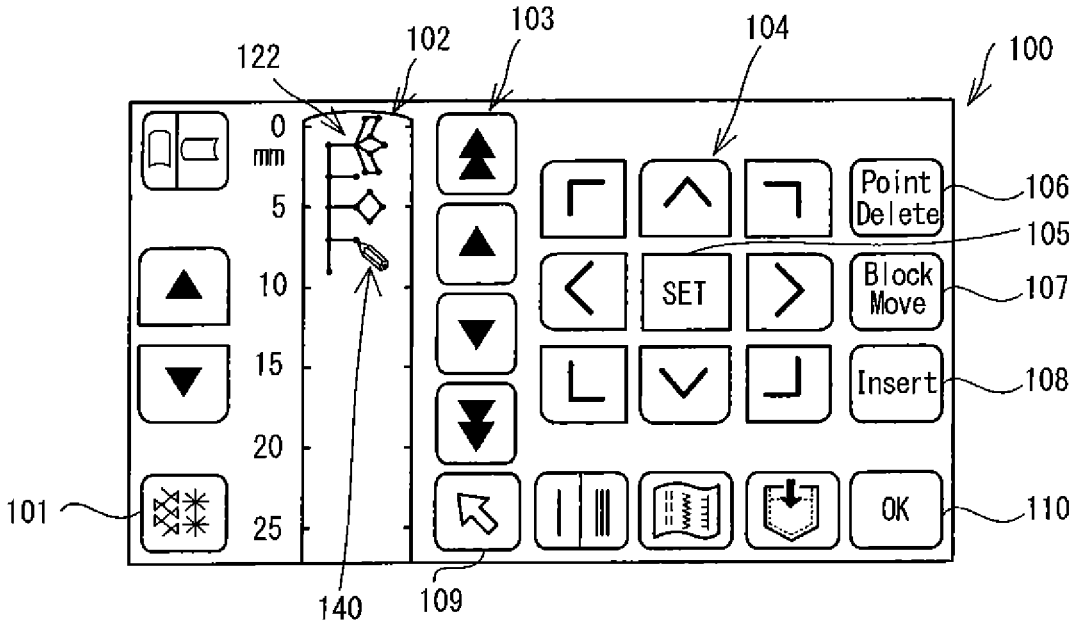
FIG. 9 is an explanatory figure of the edit screen 100, on which a smallest repeated portion 122 of a pattern 121 is disposed within a campus 102.

The campus 102 that is shown in FIG. 3 is an area in which the pattern that is being edited is displayed. As shown in FIG. 9, needle drop points in the pattern that is displayed in the campus 102 are shown as black dots, and the stitches of the pattern are shown as line segments that connect pairs of the black dots. The needle drop points are points where the sewing workpiece is pierced by the sewing needle 7 that is mounted on the lower end of the needle bar 6, which is disposed directly above the needle hole (not shown in the drawings) in the needle plate 21. The lengthwise direction of the campus 102 corresponds to the first direction, and the direction that is orthogonal to the lengthwise direction of the campus 102 corresponds to the second direction. The point movement key cluster 103 is selected in a case where one of the needle drop points that is included in the pattern that is being displayed in the campus 102 is selected. The needle drop point that is being selected is indicated by a cursor 140 (refer to FIGS. 9 and 10) that is shown as a picture of a pencil. The arrow key cluster 104 is selected in a case where the position of the needle drop point that has been selected by the cursor 140 will be moved within the campus 102. The Set key 105 is selected in a case where the needle drop point will be set at coordinates within the campus 102 that have been designated using the arrow key cluster 104. The Point Delete key 106 is selected in a case where the selected needle drop point that is displayed within the campus 102 will be deleted. The Block Move key 107 is selected in a case where a plurality of the needle drop points that are included in the pattern that is being displayed in the campus 102 will be moved as a group. The Insert key 108 is selected in a case where a new needle drop point will be added to the pattern that is being displayed in the campus 102. The area designation key 109 is selected in a case where a given range within the campus 102 is designated as a range that indicates a size and a position of a pattern.

The pattern edit processing will be explained with reference to FIGS. 4 to 10. The pattern edit processing that is shown in FIG. 4 is started in a case where the pattern edit key 101 on the edit screen 100 that is shown in FIG. 3 has been selected by a panel operation. When the CPU 61 detects the selecting of the pattern edit key 101, the CPU 61 reads into the RAM 63 a program for performing the pattern edit processing, which is stored in the program storage area of the ROM 62 that is shown in FIG. 2, and, in accordance with the instructions in the program, performs the processing at each of the steps that will hereinafter be explained. Various types of data that are produced in the course of processing are stored in the RAM 63 as necessary.

As shown in FIG. 4, the CPU 61 waits until a command has been input that designates a storage area where the sewing data are stored (NO at Step S1). In the present embodiment, the user is able to input a command that designates the storage area where the sewing data are stored that will be used for editing a pattern. The CPU 61 displays on the LCD 15 an input screen for designating the storage area. Assume for example, that the user uses a panel operation to input a command that designates the sewing data storage area 641 in the flash memory 64 that is shown in FIG. 6 as the desired storage area. As shown in FIG. 6, a pattern ID is assigned to each one of the plurality of the patterns. The sewing data for each one of the plurality of the patterns are stored in association with a sewing order, the first feed amounts, the swing positions, and the second feed amounts. However, as described previously, depending on the pattern, the sewing data may not include the second feed amounts. The sewing order indicates the order in which the stitches are formed. When the CPU 61 detects that the storage area has been designated (YES at Step S1), the CPU 61 acquires information that pertains to the sewing data storage area 641 in the flash memory 64, which has been designated, and stores that information in the RAM 63 (Step S2).

Figure 5:
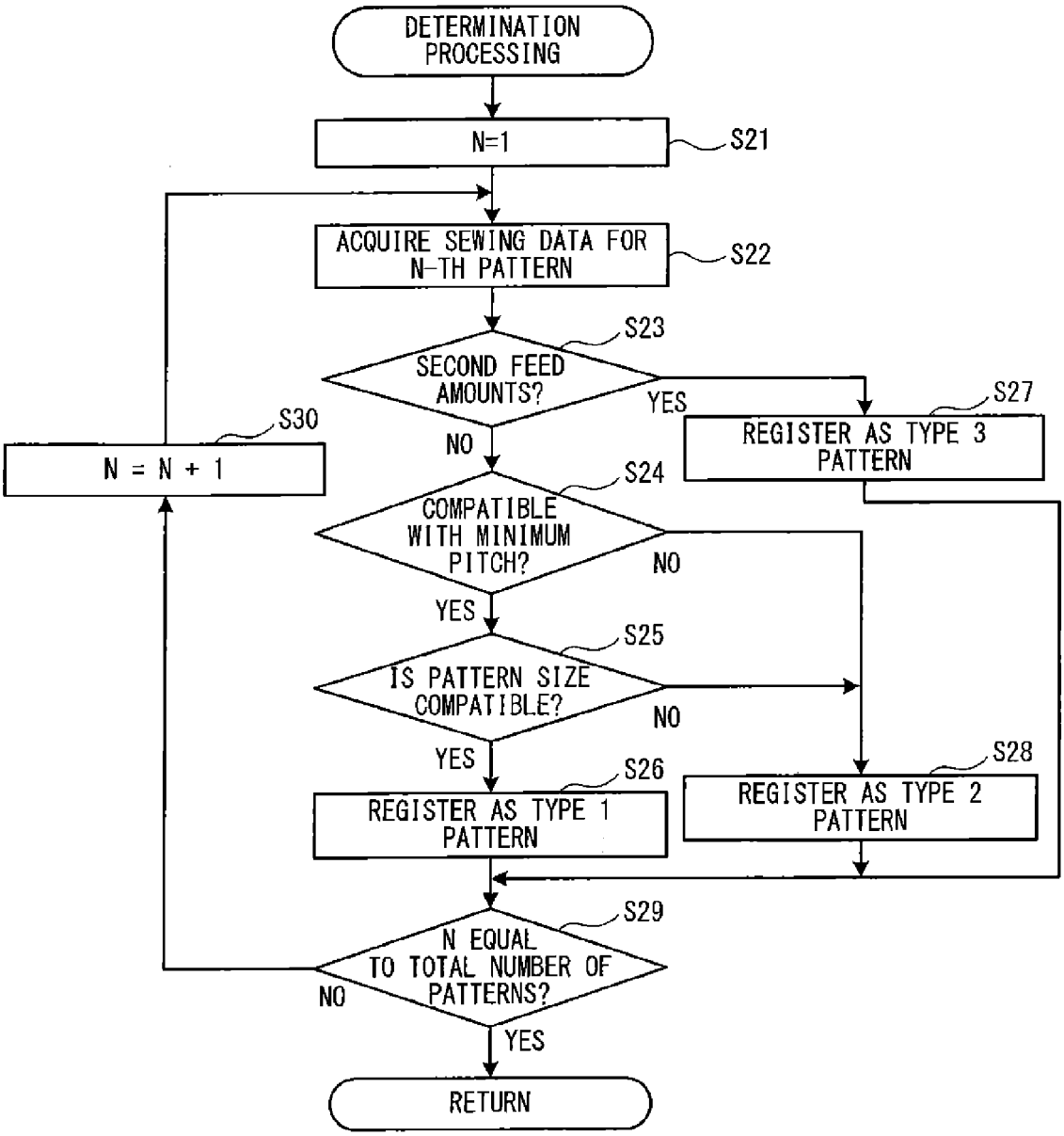
FIG. 5 is a flowchart of determination processing that is performed by the pattern edit processing in FIG. 4.

The CPU 61 performs determination processing (Step S3). The determination processing is processing that determines whether the sewing data for each one of the plurality of the patterns that are stored in the storage area that was designated at Step S1 can be edited. The determination processing will be explained with reference to FIG. 5. As shown in FIG. 5, the CPU 61 sets a variable N to 1 and stores it in the RAM 63 (Step S21). The variable N is used for reading (the sewing data for) the plurality of the patterns that are stored in the storage area that was designated at Step S1 in FIG. 4, in ascending order of the pattern ID. The CPU 61 acquires the sewing data for the N-th pattern (Step S22). The CPU 61 determines whether the sewing data for the N-th pattern that were acquired at Step S22 include the second feed amounts (Step S23). In a case where the sewing data for any one of the patterns from pattern ID 1 to pattern ID 3 in FIG. 6 were acquired as the sewing data for the N-th pattern, the CPU 61 determines that the sewing data for the N-th pattern do not include the second feed amounts (NO at Step S23). In a case where it has been determined that the sewing data for the N-th pattern do not include the second feed amounts, the CPU 61 determines whether the swing positions in the sewing data for the N-th pattern that were acquired at Step S22 are compatible with the minimum swing pitch (Step S24). The CPU 61 acquires the minimum swing pitch that will be used in making the determination from the flash memory 64.

Specifically, in a case where the swing positions in the sewing data for the N-th pattern are integer multiples of the minimum swing pitch that is stored in the flash memory 64, the CPU 61 determines that the swing positions in the sewing data for the N-th pattern are compatible with the minimum swing pitch. The swing positions in the sewing data for the patterns with the pattern ID 1 and the pattern ID 3 are integer multiples of the minimum swing pitch 0.5 millimeters. Therefore, in a case where the sewing data for either one of the patterns with the pattern ID 1 and the pattern ID 3 were acquired as the sewing data for the N-th pattern, the CPU 61 determines that the swing positions in the sewing data for the N-th pattern are compatible with the minimum swing pitch (YES at Step S24). In a case where it has been determined that the swing positions in the sewing data for the N-th pattern are compatible with the minimum swing pitch, the CPU 61 determines whether the size of the N-th pattern is compatible with the range in which the needle bar 6 can be swung (Step S25). Specifically, in a case where the swing positions in the sewing data for the N-th pattern are within the range in which the needle bar 6 can be swung by the swinging mechanism 88, the CPU 61 determines that the size of the N-th pattern is compatible with the range in which the needle bar 6 can be swung. The CPU 61 acquires the range in which the needle bar 6 can be swung that will be used in making the determination from the flash memory 64. The swing positions in the sewing data for the pattern with the pattern ID 1 are within the range in which the needle bar 6 can be swung (0.0 to 7.0 millimeters) (YES at Step S25). Therefore, the CPU 61 registers the pattern with the pattern ID 1 as a type 1 pattern and stores it in the RAM 63 (Step S26).

The swing position in the sewing data for the pattern with the pattern ID 2 is 2.3 millimeters. The swing position 2.3 millimeters is not an integer multiple of the minimum swing pitch 0.5 millimeters. Therefore, the CPU 61 determines that the swing positions in the sewing data for the pattern with the pattern ID 2 are not compatible with the minimum swing pitch (NO at Step S24). The CPU 61 registers the pattern with the pattern ID 2 as a type 2 pattern and stores it in the RAM 63 (Step S28). The swing position in the sewing data for the pattern with the pattern ID 3 is 8.0 millimeters. The swing position 8.0 millimeters is outside the range in which the needle bar 6 can be swung (0.0 to 7.0 millimeters). Therefore, the CPU 61 determines that the size of the pattern with the pattern ID 3 are not compatible with the range in which the needle bar 6 can be swung by the swinging mechanism 88 (NO at Step S25). Therefore, the CPU 61 registers the pattern with the pattern ID 3 as a type 2 pattern and stores it in the RAM 63 (Step S28).

The sewing data for pattern with the pattern ID 4 include the second feed amounts. Therefore, the CPU 61 determines that the second feed amounts are present in the sewing data for pattern with the pattern ID 4 (YES at Step S23). The CPU 61 registers the pattern with the pattern ID 4 as a type 3 pattern and stores it in the RAM 63 (Step S27). After performing any one of the Steps S26 to S28, if the CPU 61 determines that the variable N is not equal to the total number of the patterns (NO at Step S29), the CPU 61 increments the variable N by 1 (Step S30) and returns the processing to Step S22. The total number of the patterns is the total number of the patterns that are stored in the storage area that was designated at Step S1 in FIG. 4. In a case where the variable N is equal to the total number of the patterns (YES at Step S29), the CPU 61 terminates the determination processing and returns the processing to the pattern edit processing in FIG. 4.

Figure 7:
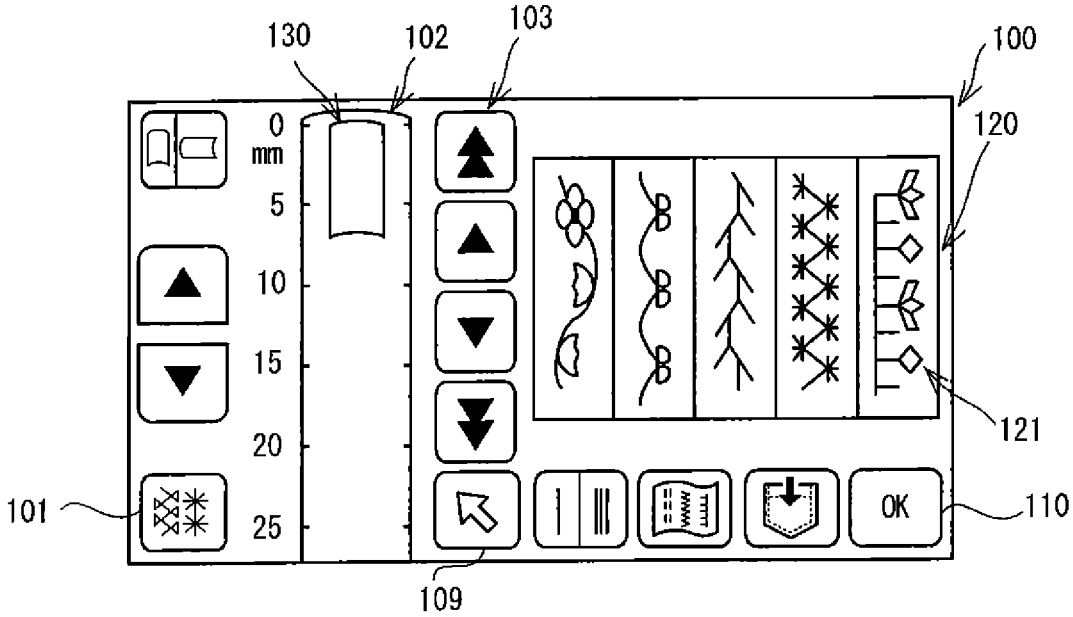
FIG. 7 is an explanatory figure of the edit screen 100, on which a selection screen 120 is displayed.

After the processing at Step S3 of the pattern edit processing in FIG. 4, the CPU 61 displays a selection screen 120, an example of which is shown in FIG. 7, on the LCD 15 (Step S4). The patterns that were registered as type 1 patterns and type 2 patterns in the processing at Step S3 are displayed on the selection screen 120, but the patterns that were registered as type 3 patterns are not displayed. In the example that is shown in FIG. 7, five patterns, including a pattern 121, are displayed on the selection screen 120. The user can use a panel operation to select a desired pattern from among the five patterns that are displayed on the selection screen 120.

The CPU 61 determines whether the selecting of the area designation key 109 has been detected (Step S5). In the present embodiment, after using a panel operation to select the area designation key 109, the user can input a command that designates a range that indicates a size and a position of a pattern by designating a given range within the campus 102. In a case where the CPU 61 has detected the selecting of the area designation key 109 (YES at Step S5), the CPU 61 acquires the area that the user has used a panel operation to input and stores the area in the RAM 63 (Step S6). In a case where the CPU 61 has not detected the selecting of the area designation key 109 (NO at Step S5), as well as after the processing at Step S6, the CPU 61 determines whether the selecting of one of the patterns that are displayed on the selection screen 120 has been detected (Step S7). In a case where the CPU 61 has not detected the selecting of a pattern (NO at Step S7), the CPU 61 returns the processing to Step S5. In a case where the CPU 61 has detected the selecting of the pattern 121, for example, on the selection screen 120 (YES at Step S7), the CPU 61 acquires the pattern ID for the selected pattern 121 and stores the pattern ID in the RAM 63 (Step S8).

Figure 8:
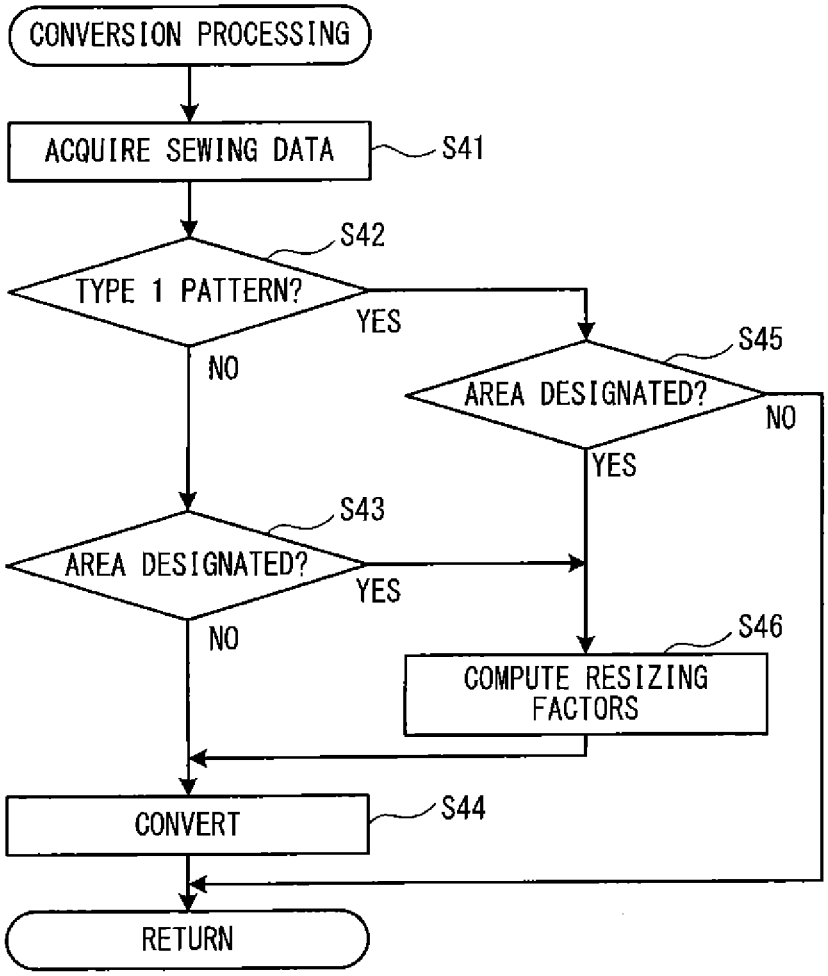
FIG. 8 is a flowchart of conversion processing that is performed by the pattern edit processing in FIG. 4.

The CPU 61 performs processing (Step S9) that converts the sewing data for the pattern 121 whose pattern ID was acquired at Step S8 into editable sewing data, as necessary. The conversion processing at Step S9 will be explained with reference to FIG. 8. As shown in FIG. 8, in the conversion processing, the CPU 61 first acquires the sewing data for the pattern 121 whose pattern ID was acquired at Step S8 in FIG. 4 and stores them in the RAM 63 (Step S41). The CPU 61 determines whether the pattern 121 whose pattern ID was acquired at Step S8 is a type 1 pattern (Step S42). The processing at Step S42 is performed based on the result of the determination at Step S3 in FIG. 4 that corresponds to the pattern 121. In a case where the pattern 121 is not a type 1 pattern, that is, in a case where it is a type 2 pattern (NO at Step S42), the CPU 61 determines whether an area was designated at Step S5 in FIG. 4 (Step S43). In a case where an area has not been designated (NO at Step S43), the CPU 61 converts the sewing data for the pattern 121 that were acquired at Step S41 into editable data (Step S44). Specifically, in a case where the maximum value of any of the swing positions in the sewing data for the pattern 121 is 10 millimeters, for example, the CPU 61 multiplies the numerical value of the each of the swing positions in the sewing data for the pattern 121 by 0.7 (7/10), such that the values will all be no greater than the 7.0 millimeters that is the range in which the needle bar 6 can be swung by the swinging mechanism 88. Then the CPU 61 sets the numerical value of the each of the swing positions such that it approximates an integer multiple of the minimum swing pitch of 0.5 millimeters for the swinging mechanism 88. At this time, in a case where the specified conditions have not been satisfied, the CPU 61 deletes the data for the needle drop points that correspond to the swing positions. Specifically, the CPU 61 computes the difference between the numerical value of a swing position and the integer multiple of 0.5 millimeters that is nearest to the numerical value of the swing position, for example. In a case where the difference is not greater than a specified threshold value, the CPU 61 sets the numerical value of the swing position to the nearest integer multiple of 0.5 millimeters. In a case where the difference is greater than the specified threshold value, the CPU 61 deletes the data for the needle drop point that corresponds to the swing position. The processing at Step S44 converts the sewing data into data in which the swing positions in the sewing data are compatible with the swing positions of needle bar 6 of the sewing machine 1.

In a case where the pattern 121 whose pattern ID was acquired at Step S8 in FIG. 4 is a type 1 pattern (YES at Step S42), the CPU 61 determines whether an area was designated at Step S5 in FIG. 4 (Step S45). In a case where an area was designated at Step S5 in FIG. 4 (YES at Step S45), the CPU 61 computes a resizing factor for each of the first direction and the second direction (Step S46). The resizing factor for the first direction is the length in the first direction of the area that was acquired at Step S6 in FIG. 4, divided by the length of the pattern 121 in the first direction. In the same manner, the resizing factor for the second direction is the length in the second direction of the area that was acquired at Step S6 in FIG. 4, divided by the length of the pattern 121 in the second direction. In this case, the length of the pattern 121 in the first direction is the sum of the first feed amounts in the sewing data for the pattern 121. Furthermore, the length of the pattern 121 in the second direction is the maximum value among the swing positions in the sewing data for the pattern 121. The CPU 61 multiplies the values in the pattern sewing data that were acquired at Step S41 by the resizing factors that were computed at Step S46 and processed to Step S44.

In a case where the pattern 121 whose pattern ID was acquired at Step S8 in FIG. 4 is a type 2 pattern and an area has been designated (YES at Step S43), the CPU 61 performs the processing at Steps S46 and S44 that is described above, then returns the processing to FIG. 4. In a case where the pattern 121 whose pattern ID was acquired at Step S8 in FIG. 4 is a type 1 pattern and an area has not been designated (NO at Step S45), the CPU 61 terminates the conversion processing and returns the processing to FIG. 4.

Figure 10:
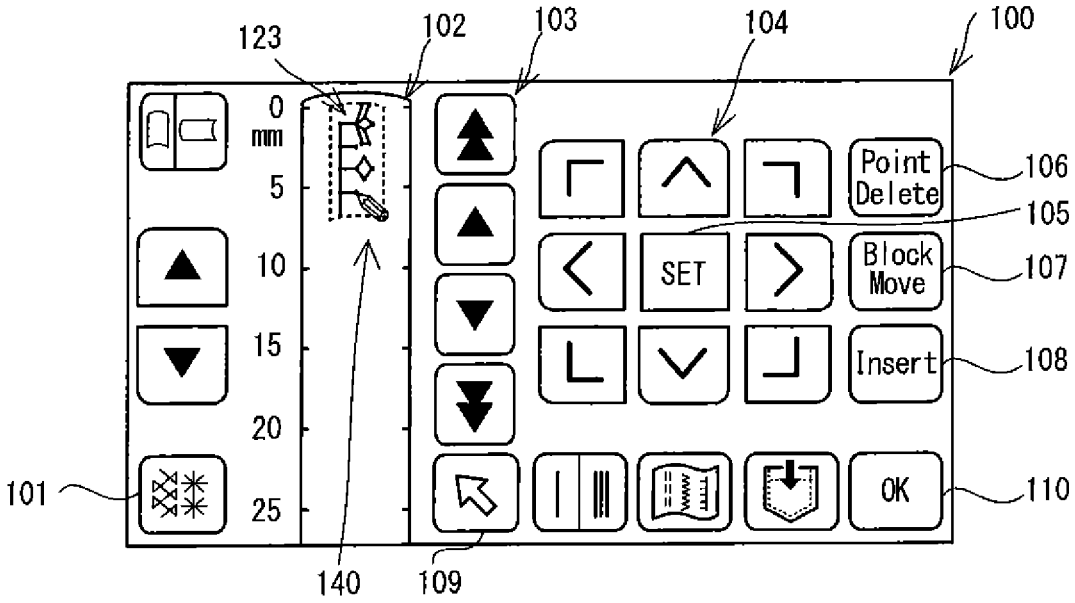
FIG. 10 is an explanatory figure of the edit screen 100, on which a smallest repeated portion 123 of the reduced pattern 121 is disposed within the campus 102.

After Step S9 in FIG. 4, the CPU 61, based on the results of the conversion processing at Step S9, updates the sewing data for the pattern 121 that are stored in the RAM 63 (Step S10), then displays the pattern 121 on the edit screen 100 on the LCD 15, based on the updated sewing data (Step S11). In the processing at Step S11, in a case where an area has not been designated (NO at Step S5), the example of the edit screen 100 that is shown in FIG. 9 is displayed, for example. A smallest repeated portion 122 of the pattern 121 that was selected at Step S7 (refer to FIG. 7) is displayed in the campus 102 such that it fits the length of the campus 102 in the second direction. In the processing at Step S11, in a case where an area 130 (refer to FIG. 7) has been designated (YES at Step S5), the example of the edit screen 100 that is shown in FIG. 10 is displayed, for example. In FIG. 10, a smallest repeated portion 123 of the pattern 121 that was selected at Step S7 is displayed in the campus 102 in reduced form, such that it fits the size of the area 130.

Figure 11:
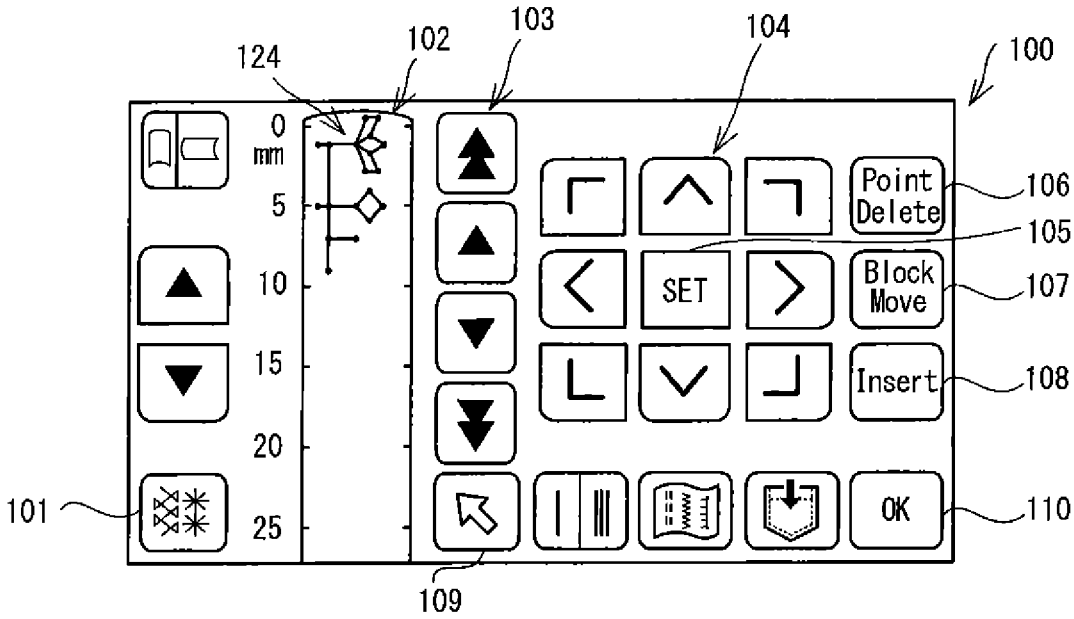
FIG. 11 is an explanatory figure of the edit screen 100, which includes an edited pattern 124.

The CPU 61 determines whether the input of an edit command has been detected (Step S12). The user can input an edit command by selecting one of the point movement key cluster 103, the arrow key cluster 104, the Set key 105, the Point Delete key 106, the Block Move key 107, and the Insert key 108 that are displayed on the edit screen 100, for example. When the CPU 61 detects an edit command, it acquires the detected edit command (Step S13). The CPU 61 edits the sewing data (Step S14) by one of moving, adding, and deleting a needle drop point that is included in the pattern, in accordance with the edit command that was acquired at Step S13. Specifically, the CPU 61, in accordance with the edit command, modifies the sewing data by one of modifying, adding, and deleting an amount that the sewing workpiece is fed by the feed mechanism 89 and a position to which the needle bar 6 is swung by the swinging mechanism 88. The method for editing the needle drop points in the pattern is known in Japanese Laid-Open Patent Publication No. 2006-43231 and the like, so a detailed explanation will be omitted. The CPU 61 accepts the command to edit a needle drop point of the pattern and performs edit processing within the range in which the swing position in the sewing data is compatible with the swing positions of the needle bar 6 of the sewing machine 1. For example, in the processing at Step S14, the smallest repeated portion 122 of the pattern 121 (refer to FIG. 7) that is shown in FIG. 9 is edited into a pattern 124 that is shown in FIG. 11 by deleting and adding needle drop points.

The CPU 61 determines whether the selecting of the OK key 110 has been detected (Step S15). In a case where the selecting of the OK key 110 has not been detected (NO at Step S15), the CPU 61 returns the processing to Step S12. The user uses a panel operation to select the OK key 110 when terminating the editing of the pattern. In a case where the selecting of the OK key 110 has been detected (YES at Step S15), the CPU 61 waits for the input of a command to start sewing to be detected (NO at Step S16). The command to start sewing is input by one of a panel operation and the pressing of the start/stop switch 29, for example. The user places the sewing workpiece on the bed 11 and presses it down with the presser foot 9, then inputs the command to start sewing. In a case where the CPU 61 has detected the inputting of the command to start sewing (YES at Step S16), the CPU 61 causes the pattern to be sewn in accordance with the edited sewing data that are stored in the RAM 63 (Step S17). At this time, the sewing machine 1 may also accept the input of a specific number of times that the pattern (the smallest repeated portion of the pattern) is to be sewn, and then sew the pattern that number of times, for example. The CPU 61 causes the edited pattern to be sewn on the sewing workpiece by operating the feed mechanism 89 and the swinging mechanism 88 in accordance with the sewing data. The CPU 61 then terminates the pattern edit processing.

The sewing machine 1 is able to save the user the trouble of determining whether each one of a plurality of sets of sewing data that are stored in the storage area that the user has designated can be edited. Specifically, the sewing machine 1 is able to determine automatically that sewing data that include data for causing the sewing workpiece to be fed in the second direction by the feed mechanism 89 (refer to FIG. 2) cannot be edited.

By selecting a desired pattern from among the editable patterns that are displayed on the LCD 15 and inputting an edit command, the user is able to cause the sewing machine 1 to edit the sewing data. On the sewing machine 1, the user is able to use a panel operation to issue a command to at least one of move, add, and delete any given needle drop point among the plurality of the needle drop points that are included in the pattern. By inputting edit commands as desired, the user can easily edit the desired pattern, utilizing the existing sewing data. By sewing the pattern in accordance with the sewing data that have been created by the editing of the existing sewing data, the sewing machine 1 is able to sew a new pattern by a procedure that is simpler than the known procedure.

The sewing machine 1 is able to edit the sewing data such that the selected pattern is enlarged or reduced to a size that the user designates. By inputting the command that designates an area, the user is able to change the size of the pattern that is described by the existing sewing data to a desired size and to place the pattern in a desired position.

The sewing machine of the present disclosure is not limited to the embodiment that is described above, and various types of modifications may be made within the scope of the present disclosure. For example, the modifications (A) to (C) below may be made as desired.

(A) The configuration of the sewing machine 1 may be modified as desired. For example, the sewing machine 1 may also be provided with a mechanism that uses the feed dog 23 to feed the sewing workpiece in the second direction. A display device need only be capable of displaying an image.

(B) A program that includes instructions for performing the pattern edit processing in FIG. 4 may also be stored in a storage device of the sewing machine 1 until the sewing machine 1 executes the program. Therefore, the method for acquiring the program, the route by which the program is acquired, and the device that stores the program may each be modified as desired. A program that the processor of the sewing machine 1 executes may also be received from another device through a cable or by wireless communication, and may also be stored in a storage device such as a flash memory or the like. The other device may be a PC or a server that is connected through a network, for example.

(C) The individual steps in the pattern edit processing in FIG. 4 are not limited to the example of being performed by the CPU 61, and some or all of them may also be performed another electronic device (for example, an ASIC). The individual steps in the processing described above may also be performed by distributed processing among a plurality of electronic devices (for example, a plurality of CPUs). The individual steps in the pattern edit processing in the embodiment that is described above can be deleted and added, and their order may be modified, as necessary. A case in which some or all of the actual processing is performed by an operating system (OS) or the like that runs in the sewing machine 1 based on instructions from the CPU 61 of the sewing machine 1, and in which the functions of the embodiment that is described above are fulfilled by that processing, is also included in the scope of the present disclosure. For example, the modifications (C-1) to (C-4) below may be made to the pattern edit processing as desired.

(C-1) It is acceptable for the CPU 61 not to accept the designating of the storage area at Step S1. In that case, the CPU 61 may treat the sewing data that are stored in a specified storage device as the object of the determination processing. It is also acceptable for the CPU 61 not to accept the designating of the area at Step S5. At Step S5, the CPU 61 may accept only the designating of the position where the pattern is disposed or only the designating of the resizing factor for enlarging or reducing the pattern.

(C-2) The standard for determining whether the sewing data for a pattern can be edited may also vary according to the configuration of the sewing machine 1. The CPU 61 may also store, in a non-volatile storage device (for example, the flash memory 64), determination results that correspond to a plurality of sets of sewing data and then omit further determination processing for those sets of the sewing data for which the determination results have been stored. In other words, the CPU 61 may determine whether the sewing data can be edited based on the determination results that correspond to the sewing data and are stored in the storage device.

(C-3) The CPU 61 may also modify, as desired, the form in which the selection screen is displayed at Step S4. For example, the CPU 61 may display the selection screen on the LCD 15 in a form that makes it possible to distinguish, according to the determination results, between an editable pattern that is described by editable sewing data and a non-editable pattern that is described by non-editable sewing data. The form that makes it possible to distinguish between the editable patterns and the non-editable patterns may be, for example, a form that makes it possible for the user to make the distinction visually. For example, the form that makes it possible to make the distinction visually may be a form in which the editable patterns and the non-editable patterns are respectively displayed in different display areas. Another way to distinguish between the editable patterns and the non-editable patterns may be to use different colors for the lines that describe the patterns or to use different colors for the backgrounds, for example.

(C-4) The types of the edit commands that are accepted at Step S12 in FIG. 4 may also be modified as desired. For example, the CPU 61 may also accept an enlarging or reducing factor for a pattern or a block as an edit command. In that case, in the processing at Step S14, the CPU 61 may perform processing that enlarges or reduces a pattern or a block, in accordance with the edit command.

What is claimed is:

1. A sewing machine, comprising:

a needle bar;

a feed mechanism that is configured to move a sewing workpiece in a first direction;

a swinging mechanism that is configured to swing the needle bar in a second direction intersecting with the first direction;

a display device; and a control device that is configured to determine whether each of a plurality of sets of sewing data stored in a storage device is editable, each of the plurality of the sets of the sewing data being data for sewing a pattern, display at least one editable pattern on the display device based on a result of the editability determination, the at least one editable pattern being a pattern that is described by one of the plurality of the sets of the sewing data determined as being editable, acquire a selection command that selects, from the at least one editable pattern that is displayed on the display device, an object pattern subject to editing, acquire an edit command to edit the object pattern that is selected by the acquired selection command, edit object sewing data in accordance with the acquired edit command, the object sewing data being one of the plurality of the sets of the sewing data for the object pattern, and cause the sewing machine to sew the object pattern selected by the acquired selection command on the sewing workpiece by operating the feed mechanism and the swinging mechanism based on the edited object sewing data.

2. The sewing machine according to claim 1, wherein the determination by the control device of whether each of the plurality of the sets of sewing data is editable includes determining that one of the plurality of the sets of the sewing data is non-editable when the set of the sewing data includes data for causing the feed mechanism to move the sewing workpiece in the second direction.

3. The sewing machine according to claim 2, wherein the displaying by the control device of the at least one editable pattern on the display device includes displaying the at least one editable pattern and at least one non-editable pattern on the display device in a form that enables the at least one editable pattern and the at least one non-editable pattern to be distinguished from one another, the at least one non-editable pattern being a pattern that is described by one of the plurality of the sets of the sewing data that has been determined to be non-editable.

4. The sewing machine according to claim 1, wherein the edit command includes at least one of: (i) a command to move, (ii) a command to add and (iii) a command to delete, a selected needle drop point among a plurality of needle drop points that are included in the object pattern, and the editing by the control device of the object sewing data includes performing, in accordance with the edit command, at least one of: (i) modifying, (ii) adding and (iii) deleting, of at least one of a feed amount and a swing postion that are included in the object sewing data, the feed amount is an amount that the sewing workpiece is moved by the feed mechanism when the object pattern is sewn based on the object sewing data, and the swing position is a position to which the needle bar is swung by the swinging mechanism when the object pattern is sewn based on the object sewing data.

5. The sewing machine according to claim 1, wherein the edit command includes a size command that designates a size of the object pattern, and the editing of the object sewing data performed by the control device includes editing the object sewing data such that the size of the object pattern is one of: (i) enlarged as compared to the size that is designated by the size command, and (ii) reduced as compared to the size that is designated by the size command, when the edit command is the size command.

6. A non-transitory computer-readable medium configured to store computer-readable instructions executable on a sewing machine, when executed by the sewing machine, the instructions performing processes comprising:

determining whether each of a plurality of sets of sewing data stored in a storage device is editable, each of the plurality of the sets of the sewing data being data for sewing a pattern;

displaying at least one editable pattern on a display device based on a result of the editability determination, the at least one editable pattern being a pattern that is described by one of the plurality of the sets of the sewing data determined as being editable;

acquiring a selection command that selects, from the at least one editable pattern that is displayed on the display device, an object pattern subject to editing;

acquiring an edit command to edit the object pattern that is selected by the acquired selection command;

editing object sewing data in accordance with the acquired edit command, the object sewing data being one of the plurality of the sets of the sewing data for the object pattern; and sewing the object pattern on a sewing workpiece by operating a feed mechanism and a swinging mechanism based on the edited object sewing data, the feed mechanism moving the sewing workpiece in a first direction, and the swinging mechanism swinging a needle bar in a second direction intersecting the first direction.

* * * * *